US007980112B2

(12) United States Patent
Boersma

(10) Patent No.: US 7,980,112 B2
(45) Date of Patent: Jul. 19, 2011

(54) MODULAR TOOLING SYSTEM AND METHOD

(75) Inventor: Drew H. Boersma, Comstock Park, MI (US)

(73) Assignee: Advanced Tooling Systems, Inc., Comstock Park, MI (US)

( * ) Notice: Subject to any disclaimer, the term of this patent is extended or adjusted under 35 U.S.C. 154(b) by 950 days.

(21) Appl. No.: 11/709,951

(22) Filed: Feb. 23, 2007

(65) Prior Publication Data

US 2008/0202190 A1 Aug. 28, 2008

(51) Int. Cl.

| | |
|---|---|
| ***B21D 37/00*** | (2006.01) |
| ***B21J 13/00*** | (2006.01) |
| ***B21J 13/04*** | (2006.01) |
| ***B21D 26/00*** | (2006.01) |

(52) U.S. Cl. ..... 72/482.91; 72/446; 72/455; 72/466.9

(58) Field of Classification Search ..... 72/446, 72/448, 455, 456, 482.91, 351, 433, 434, 72/444, 465.1, 466.8, 466.9, 405.06, 405.16; 83/532, 698.71

See application file for complete search history.

(56) References Cited

U.S. PATENT DOCUMENTS

| | | | | |
|---|---|---|---|---|
| 1,149,694 | A | 8/1915 | Sonneborn | |
| 1,825,067 | A | 9/1931 | Johnson | |
| 2,433,226 | A | 12/1947 | Leblanc | |
| 2,689,539 | A | 9/1954 | Lyon | |
| 2,860,684 | A | 11/1958 | Palouian | |
| 3,702,560 | A | 11/1972 | Weidel | |
| 3,848,494 | A | 11/1974 | Gargrave et al. | |
| 3,949,589 | A | 4/1976 | Johnson et al. | |
| 4,151,976 | A | 5/1979 | Schurman | |
| 4,254,999 | A | 3/1981 | Davidson | |
| 4,282,736 | A | 8/1981 | Mashburn | |
| 4,326,402 | A | 4/1982 | Wallis | |
| 4,669,297 | A | 6/1987 | Fisch | |
| 4,698,894 | A | 10/1987 | Lingaraju et al. | |
| 5,799,532 | A | 9/1998 | Lewis | |
| 5,974,852 | A | 11/1999 | Nieschulz | |
| 6,644,091 | B2 | 11/2003 | Huang et al. | |
| 6,691,547 | B2 * | 2/2004 | Cutshall et al. | 72/404 |
| 6,848,290 | B2 | 2/2005 | Pyper et al. | |
| 6,874,346 | B1 | 4/2005 | Faymonville | |
| 7,000,446 | B2 * | 2/2006 | Nieschulz et al. | 72/350 |
| 7,024,910 | B2 | 4/2006 | Pyper et al. | |
| 2004/0069041 | A1 | 4/2004 | Pyper et al. | |
| 2004/0231398 | A1 | 11/2004 | Bliss | |
| 2005/0061049 | A1 | 3/2005 | Durney et al. | |
| 2005/0097938 | A1 | 5/2005 | Pyper et al. | |

* cited by examiner

*Primary Examiner* — Edward Tolan
*Assistant Examiner* — Mohammad Yusuf
(74) *Attorney, Agent, or Firm* — Varnum, Riddering, Schmidt & Howlett LLP

(57) ABSTRACT

A die having various features such as spring pockets and mounting provisions for a lifter bar that can be utilized to make a variety of dies. The dies may include pockets or other mounting features that provide for mounting replaceable plates that can be machined for mounting of die forming and cutting steels and other die components. The die shoe may include an array of pockets or blind holes for mounting nitrogen springs or the like for operation of forming steels and the like. One or more openings may be drilled in the replaceable plates above the pockets selected to receive nitrogen springs, with the remaining unused pockets being covered by the replaceable plate. The replaceable plate and pre-formed spring pockets thereby permit the die to be readily adapted for a particular die. The replaceable plates may be removed, and a replacement plate may be installed as needed for a new die.

22 Claims, 9 Drawing Sheets

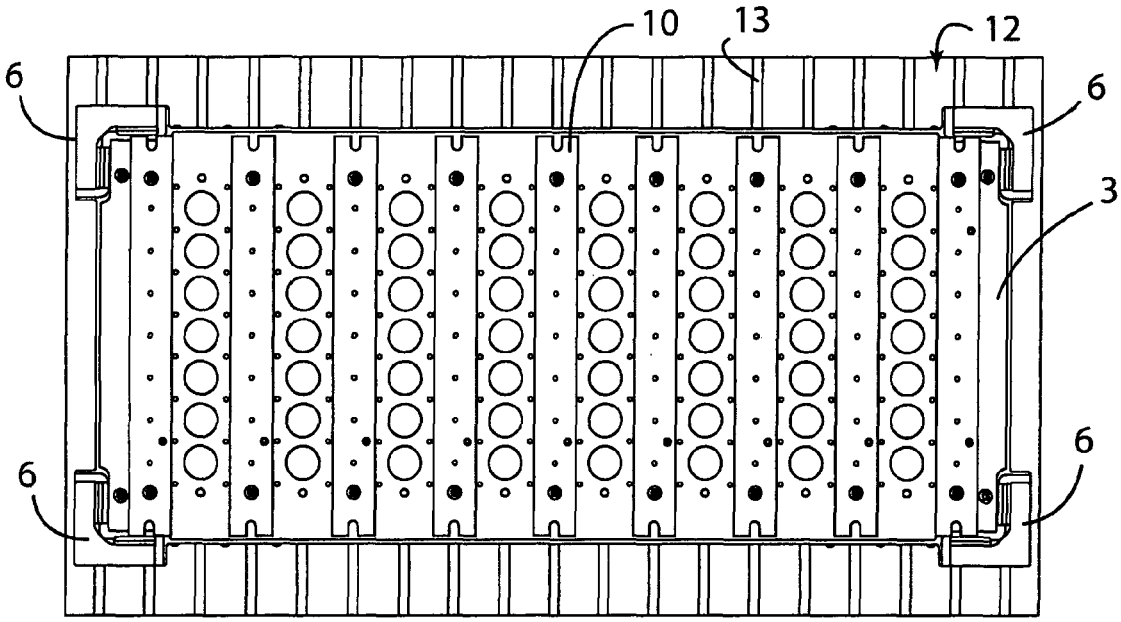
FIG. 5
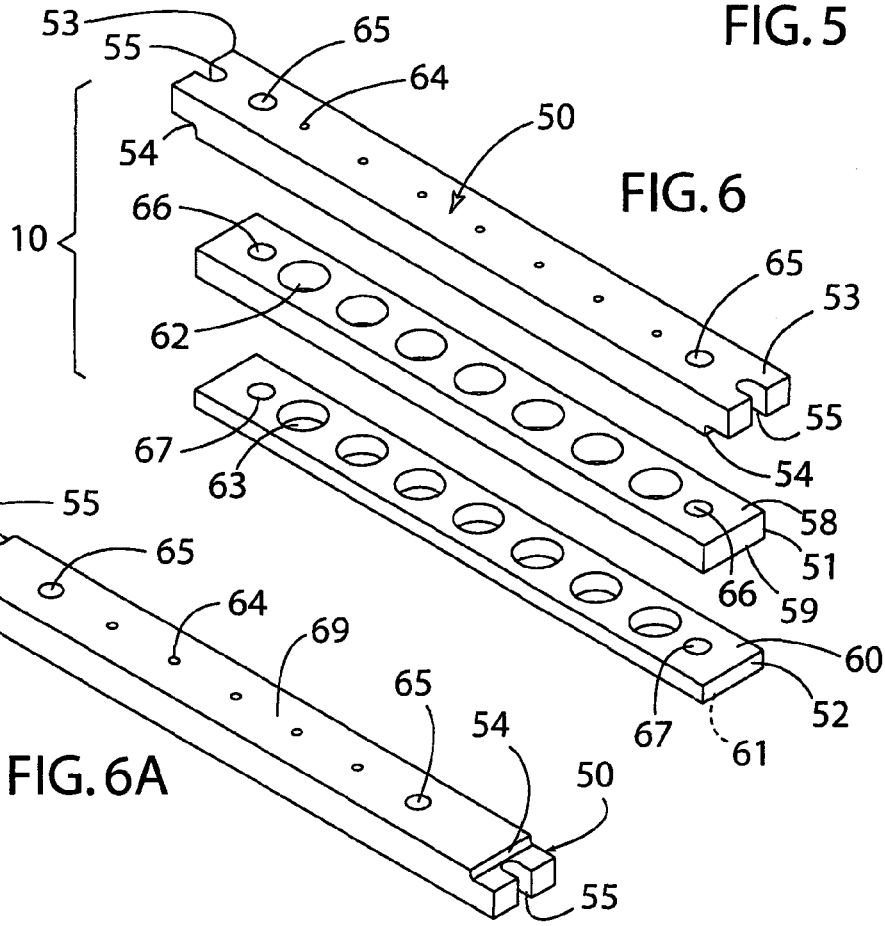
FIG. 6
FIG. 6A

MODULAR TOOLING SYSTEM AND METHOD

BACKGROUND OF THE INVENTION

Dies are one type of tool commonly used to form sheet metal into various parts. Such dies typically include various forming and cutting steels that are mounted to a pair of die shoes. The dies often include various spring-loaded components that provide forming functions and the like.

Due to the number of mounting holes and other features that are machined into the die shoes for mounting of the die steels and other components, die shoes typically cannot be re-used they have been modified to build a specific die.

During the development of a product, a number of prototypes are often built prior to finalizing the design. Prototype parts may be made in prototype dies that have been built from cast steel and other components that are not normally durable enough production runs of parts. Thus, after a relatively small run of prototype parts, the dies are typically scrapped. Although the die shoes are not typically worn out after such use, the die shoes are not normally re-usable due to the holes and other features machined into the shoes for a particular application. The need to provide new die shoes for each prototype die substantially increases the expense associated with producing prototype parts, and also represents a significant waste of material.

Accordingly, a tooling system that alleviates the problems associated with existing dies would be beneficial.

SUMMARY OF THE INVENTION

One aspect of the present invention is a die having various features such as spring pockets and mounting provisions for a lifter bar that can be utilized to make a variety of dies. The dies may include pockets or other mounting features that provide for mounting replaceable plates that can be machined for mounting of die forming and cutting steels and other die components. The die shoe may include an array of pockets or blind holes for mounting nitrogen springs or the like for operation of forming steels and the like. One or more openings may be drilled in the replaceable plates above the pockets selected to receive nitrogen springs, with the remaining unused pockets being covered by the replaceable plate. The replaceable plate and pre-formed spring pockets thereby permit the die to be readily adapted for a particular die. The replaceable plates may be removed, and a replacement plate may be installed as needed for a new die.

A modular die according to the present invention may also include adjustable-height parallels having a plurality of plates that can be selected to provide the desired overall die dimension. Still further, a modular die according to the present invention may include one or more lifter bars that are adjustably connected to the die shoes. The lifter bars include a horizontally extending bar with opposite ends that are slidably mounted to vertical guides. The lifter bar is biased away from the die shoe to which it is mounted by springs or the like in the vertical guides. The vertical guides are, in turn, adjustably mounted to the die shoes via slots in the die shoes or the like, such that the position of the lifter bar can be readily adjusted as required for a particular die. The lifter bar may include a replaceable insert for mounting a guide pin or the like. After a die is no longer needed, the insert can be removed from the lifter bar, and a new guide pin or the like can be mounted to the lifter bar in a new location as required for a new set of die forming and cutting steels used to make a new, different part.

These and other features, advantages, and objects of the present invention will be further understood and appreciated by those skilled in the art by reference to the following specification, claims, and appended drawings.

BRIEF DESCRIPTION OF THE DRAWINGS

FIG. 5 is a top plan view of the tooling system of FIG. 1;

FIG. 6 is an exploded isometric view of a multi-piece parallel of the tooling system of FIG. 1;

DETAILED DESCRIPTION OF PREFERRED EMBODIMENT

This application is related to co-pending U.S. patent application Ser. No. 11/710,143, filed on Feb. 23, 2007, entitled PRECISION NOTCH MACHINING FIXTURE AND METHOD, the entire contents of which are incorporated herein by reference.

Figure 1:
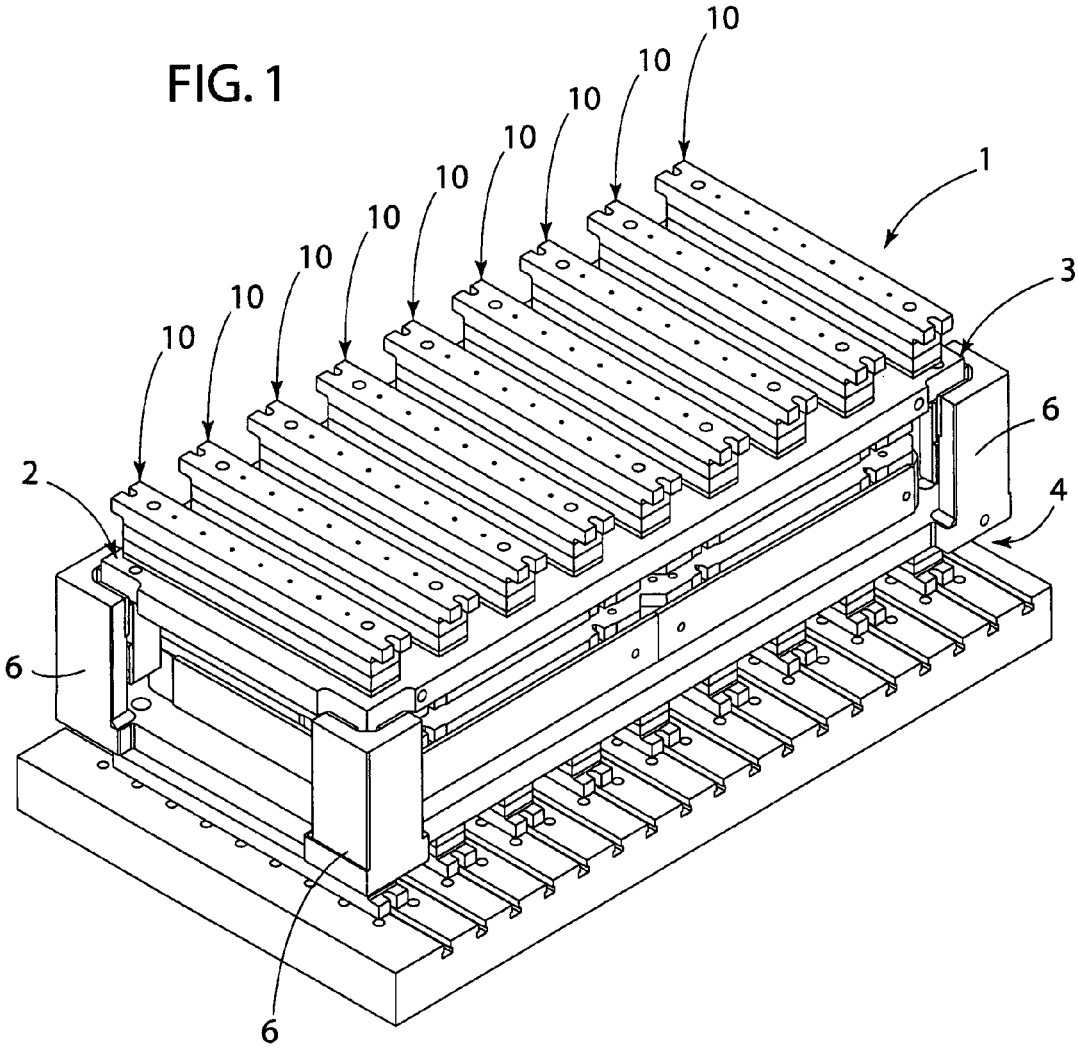
FIG. 1 is a perspective view of a tooling system according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
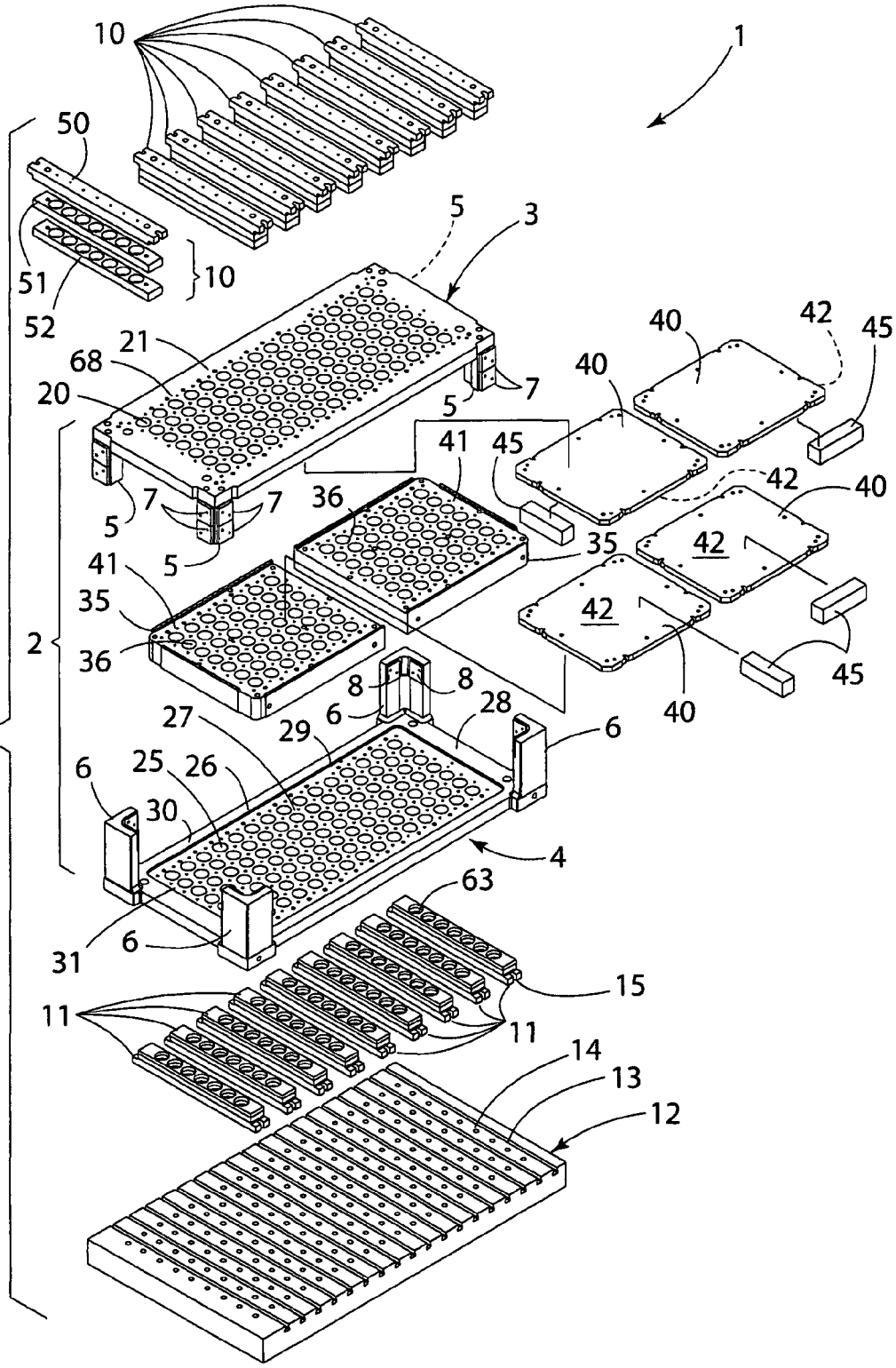
FIG. 2 is an exploded view of the tooling system of FIG. 1.

With reference to FIGS. 1 and 2, a tooling system 1 according to one aspect of the present invention comprises a die set 2 including an upper die shoe 3 and a lower die shoe 4 that are slidably interconnected by guide pins 5 on upper die shoe 3 and heel 6 on lower die shoe 4. A plurality of bearing plates 7 on guide pins 5 engage bearing plate 8 on heel 6 of lower die shoe 4 to thereby slidably interconnect the upper and lower die shoes 3 and 4, respectively. The bearing plates 7 and 8 may be made of brass or other such suitable material.

As described in more detail, a plurality of multi-piece upper parallels 10 are secured to the upper die shoe 3, and a plurality of multi-piece lower parallels 11 are secured to the lower die shoe 4. In use, the upper and lower parallels 10 and 11, respectively, are utilized to secure the tooling system 1 to the bolsters of a press machine. The parallels 11 are utilized to secure the lower die shoe 4 to a lower bolster 12 of a press, and the upper parallels 10 are used to secure the upper die shoe 3 to an upper bolster (not shown). Bolster 12 includes a plurality of T-slots 13 and threaded openings 14 that provide for connecting the ends 15 of parallels 11 to the bolster 12 in a known manner.

Figure 3:
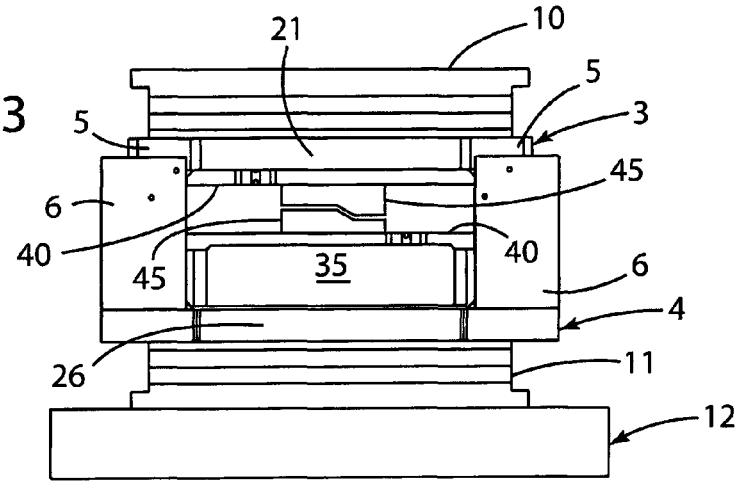
FIG. 3 is a side elevational view of the tooling system of FIG. 1.
Figure 4:
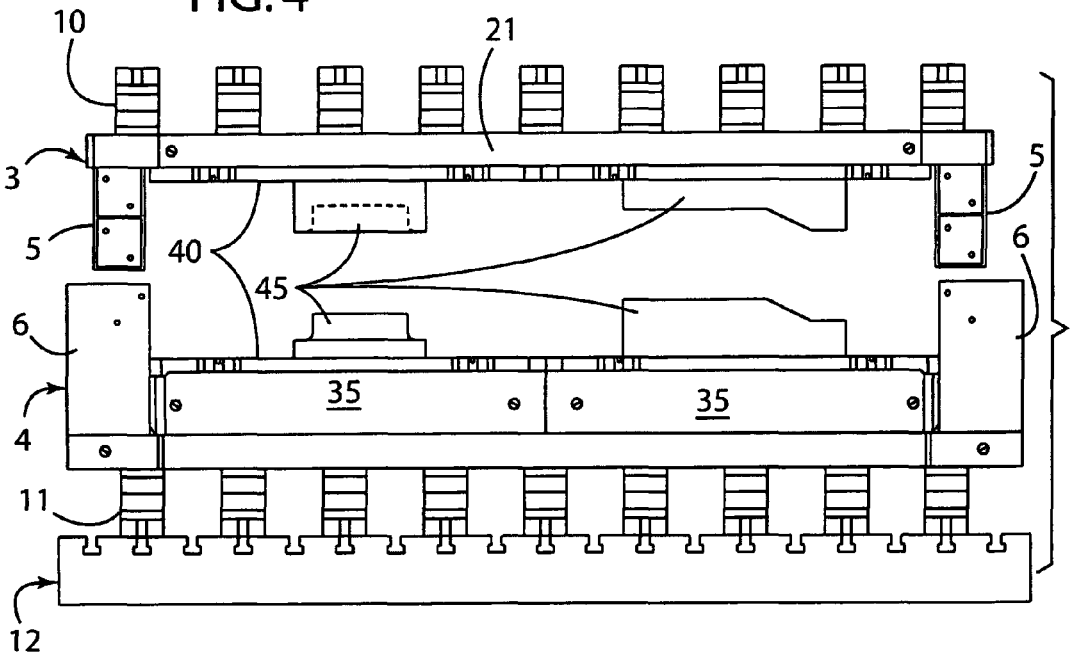
FIG. 4 is a partially exploded front elevational view of the tooling system of FIG. 1.
Figure 7:
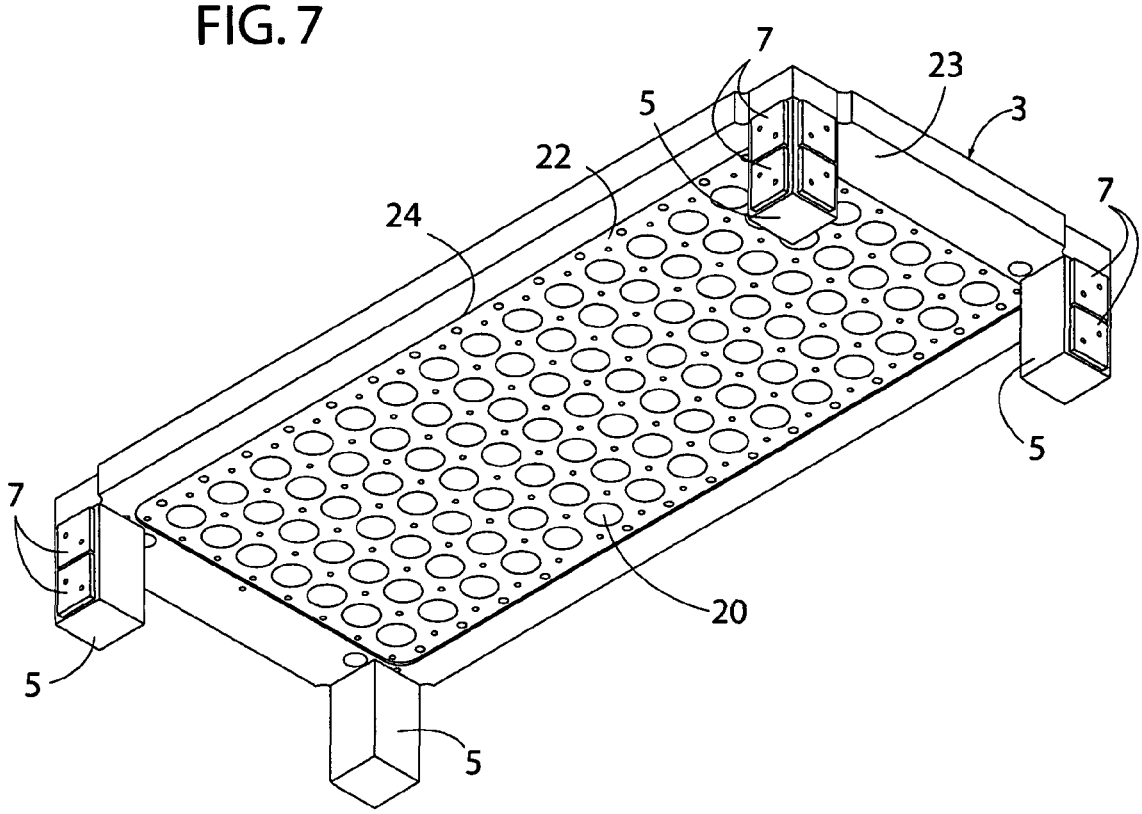
FIG. 7 is an isometric view of an upper die shoe of the tooling system of FIG. 1.

Upper die shoe 3 includes a plurality of openings 20 through the plate 21 of die shoe 3, and lower die shoe 4 includes a plurality of openings 25 through the plate 26 of lower die shoe 4. As discussed in more detail below, the openings 20 and 25 are utilized for mounting of nitrogen springs or the like to provide a biasing force for operation of various metal-forming die components and the like. An enlarged shallow pocket 27 is formed in inner side 28 of plate 26 of lower die shoe 4. The shallow pocket 27 is bounded by a small lip or edge 29 extending between plate surface 30 and surface 31 forming the bottom of shallow pocket 27. Risers 35 and 36 may be positioned in shallow pocket 27 and secured to the lower die shoe 4 utilizing conventional threaded fasteners or the like (not shown). As discussed in more detail below, the risers 35 and 36 include a plurality of through-openings 36 that align with openings 25 in lower die shoe 4 when assembled to thereby provide clearance for nitrogen springs and the like. Risers 35 and 36 act as spacers to reduce the "shut height" of the die set 2 if required for a particular die. A pair of plate-like cartridges 40 are secured to the top sides 41 of risers 35, and a second pair of cartridges 40 are secured to inner side 23 (see also FIG. 7) of upper die shoe 3 in shallow pocket 22 of upper die shoe 3. Shallow pocket 22 of upper die shoe 3 is substantially similar to the shallow pocket 27 of lower die shoe 4, and includes a lip or edge 24 that forms a parameter of pocket 22. As discussed in more detail below, the plate-like cartridges 40 are secured to the upper and lower die shoes 3 and 4, respectively via conventional fasteners or the like such that the cartridges 40 can be readily installed or removed. Various die steels or components 45 (see also FIGS. 3 and 4) are secured to the inner surfaces 42 of the cartridges 40. The die steels or components 45 may be any one of a variety of metal forming and/or cutting steels of the type utilized to fabricate a draw die or various metal-forming stations of a conventional progressive die. In use, the upper and lower die shoes 3 and 4, respectively, are brought together by operation of the press machine, and a piece of sheet metal or the like, is positioned on the die steels 45 of lower die shoe 4. The die shoes 3 and 4 are then brought together by operation of the press to thereby deform the sheet metal due to the interaction between the die steels or components 45 mounted on the upper and lower die shoes 3 and 4, respectively. Because the cartridges 40 can be installed and/or removed from the upper and lower die shoes 3 and 4, a different set of die steels 45 mounted to a different set of cartridges 40 can be readily installed to the die set 2 to thereby reconfigure the die set to fabricate an entirely different part having different shapes and/or sizes. In this way, the die shoes 3 and 4 can be reused to fabricate various parts having different sizes and configurations, and the need to build an entirely new die "from scratch" with a new die set is thereby eliminated.

With further reference to FIG. 6, each upper parallel 10 includes a base or primary member 50, and one or more elongated spacer members 51 and 52. The base member 50 includes opposite ends 53 extending beyond edge surface 54. Slots 55 in ends 53 of base members 50 provide for securing the parallels 10 to a bolster of a conventional press utilizing threaded fasteners or the like. The fasteners 51 and 52 have an overall length that is approximately the same as the distance between the edge surfaces 54 of base member 50. Spacer member 51 includes opposite side surfaces 58 and 59 that are parallel to one another, and spacer 52 includes opposite side surfaces 61 that are similarly parallel to one another. Spacer 51 includes a plurality of enlarged through-holes 62, and spacer 52 similarly includes a plurality of through-holes 63. The through-holes 62 and 63 have the same diameter and spacing as do the openings 30 through plate 21 of upper die shoe 3. When the upper parallels 10 are installed to the upper die shoe 3, the openings 62 and 63 align with the openings 20, and thereby permit all or part of a nitrogen spring to be disposed within through-holes 62 and 63. A plurality of smaller openings 64 through base member 50 are positioned at the same center-to-center distance as are the through-holes 62 and 63 in spacer members 51 and 52. The smaller openings 64 provide for connection of a nitrogen spring to the base member 50. Clearance openings 65 extend through base member 50, and align with clearance openings 66 through spacer 51 and clearance openings 67 in spacer 52, and thereby provide for conventional threaded fasteners (not shown) that are utilized to secure the parallels 10 to the upper die shoe 3 utilizing threaded openings 68 (FIG. 2) in upper die shoe 3.

With further reference to FIG. 6A, upper surface 69 of base member 50 is generally flat, and thereby forms a flat bottom for openings 62 and 63 to thereby support nitrogen cylinders positioned in the through-holes 62 and 63.

During assembly of tooling system 1, the appropriate size and number of spacers 51 and/or 52 are selected to provide the proper spacing between upper die shoe 3 and the upper bolster (not shown) of the press machine, and/or to provide for the proper overall height of the tooling system 1 as required for use in a particular die. Also, it will be readily understood that different die steels 45 and related die components may require that the overall height of the parallels be adjusted for a particular application. In the illustrated example, the spacer 51 is two inches thick, and spacer 52 is one inch thick. However, the spacers may have virtually any thickness, and the number of spacers utilized will depend upon the particular requirements of a given set of die steels 45. It will be understood that the lower parallels 11 have substantially the same multi-piece construction as upper parallels 10.

Figure 8:
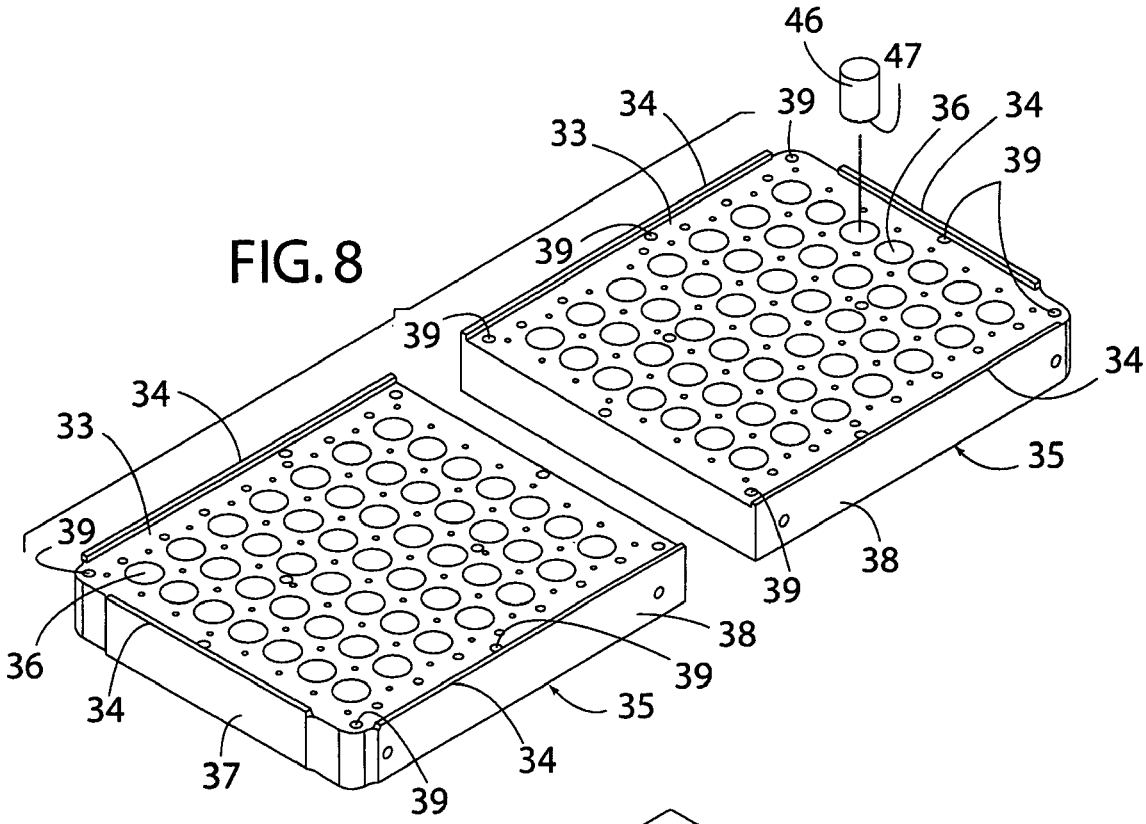
FIG. 8 is an exploded perspective view of a pair of plates that may be utilized in the tooling system of FIG. 1.

With further reference to FIG. 8, risers 35 include a plurality of through-openings 36 arranged in rows such that through-openings 36 align with openings 25 in lower die shoe 4 when assembled thereto. Outer surfaces 37 and 38 of risers 35 are configured to fit closely against lip or edge 29 of lower die shoe 4 when assembled to thereby position risers 35 relative to lower die shoe 4. A plurality of clearance openings 36 receive threaded fasteners (not shown) or the like to secure the risers 35 to the lower die shoe 4. Risers 35 include raised lips or edges 34 extending along the outer side surfaces 37 and 38. The lips 34 form shallow pockets 33 that receive and locate cartridges 42. In the illustrated example, risers 35 are only installed on the lower die shoe 4. However, it will be understood that the risers 35 may also be installed to the upper die shoe 3 if required for a particular application. The risers 35 are utilized to adjust the shut height of the die set 2 to thereby enable forming steel or the like if the shapes of the die steels 45 require bringing the die shoes 3 and 4 together closer than otherwise be possible due to contact between the ends of guide pins 5 and plate 26 of lower die shoe 4. Also, it will be understood that a single riser 35 may be installed to the lower die shoe 4, and a first set of die steels may be mounted on a cartridge 40 mounted to the riser 35, and a second set of die steels may be mounted to a cartridge 40 that is mounted directly to the lower die shoe 4. In this way, the die set 2 may have two distinct areas for forming two different parts, or for different forming operations on a single part, wherein the forming operations require different shut heights for the die.

As discussed above, one or more nitrogen springs 46 may be placed in the openings 36. The end 47 of nitrogen spring 46 will bear against the flat surface 69 of a parallel member 50 (FIG. 6A). Alternately, if required for a particular application, flat disc-like spacers (not shown) or the like may be positioned in the clearance openings 36 and/or 62 and 63 (FIG. 6) to thereby provide the proper working height for the nitrogen spring 46. Also, if the nitrogen spring 46 is a relatively small unit having an outer diameter that is substantially smaller than that of the openings 36, a sleeve (not shown) or the like having cylindrical inner and outer surfaces may be installed in the openings 36 and/or 62 and 63 to thereby position the nitrogen spring 46 in the middle of the openings 36. In this way, the openings 36 and the corresponding openings in the parallels can be readily adapted to provide for mounting of a wide range of nitrogen springs 46 having different sizes as required for a particular application.

Figure 9:
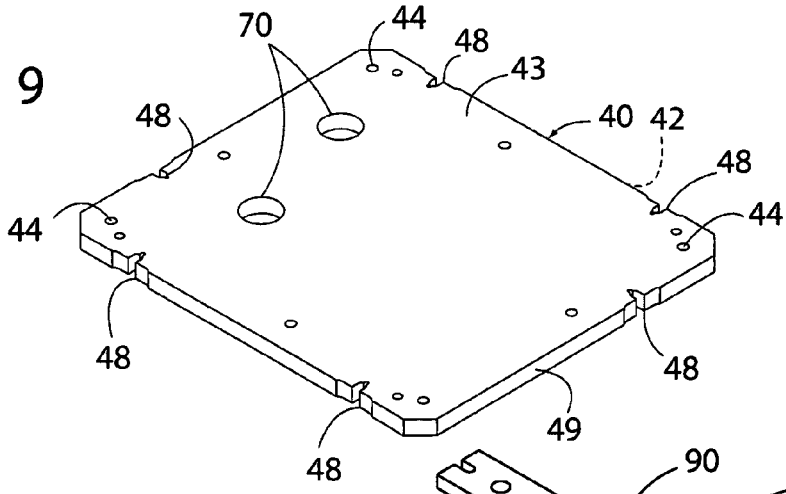
FIG. 9 is an isometric view of a replaceable plate that may be utilized in the tooling system of FIG. 1.

With further reference to FIG. 9, each plate-like cartridge 40 includes flat parallel surfaces 42 and 43, and a plurality of openings 44. The openings 44 receive conventional threaded fasteners (not shown) or the like to secure the cartridges 40 to the die shoes 3 and 4, and/or to secure the cartridges 40 to the risers 35 if the risers 35 are utilized for a particular application. Dowel pins (not shown) or the like may also be utilized to locate the cartridges 40 relative to the upper and lower die shoes 3 and 4 and/or risers 35 if required for a particular application. Cartridges 40 include a plurality of notches 48 in peripheral edge surface 49 of cartridge 40. As described in detail in co-pending U.S. patent application Ser. No. 11/710,143, filed on Feb. 23, 2007 entitled PRECISION NOTCH MACHINING FIXTURE AND METHOD, notches 48 may be utilized to secure cartridge 40 to a milling machine or the like during various machining operations to form openings 44 and/or other features as required for a particular application. The entire contents of U.S. patent application Ser. No. 11/710,143 are hereby incorporated by reference.

During assembly of tooling system 1, various holes and other features are machined into cartridges 40, and one or more die steels 45 or other die components are mounted to the cartridges 40. If required, through-holes 70 are formed in cartridge 40 to provide clearance for nitrogen springs 46 positioned in the openings 36 of risers 35 and/or the openings 63 in parallels 10 and/or 11. It will be understood that a wide range of movable forming steels and the like may be mounted to the cartridges 40. For example, if the tooling system 1 is being configured to be a draw die, a binder will be mounted to a lower cartridge 40, with the binder operably connected to the nitrogen springs through openings 70 in cartridge 40. The forming plate (not shown) is mounted to the corresponding cartridge 40 mounted on the upper die shoe 3. In operation, as the die shoes 3 and 4 are brought together, the forming plate engages the sheet of metal, and pulls the binder down as the metal is formed. If the die steels 45 are similar to those utilized in a conventional progressive die, the die steels 45 will be substantially the same as those used in a particular station of a conventional progressive die. In this application, nitrogen springs may be utilized for lifters utilized to strip the sheet metal from punches. In this application, the appropriate holes 70 are provided in cartridge 40 for the nitrogen springs that are utilized with the lifters. It will be understood that the openings 70 are normally only provided above the openings 36 in risers 35 having nitrogen springs positioned in them, such that the cartridge 40 closes off many of the openings 36 to provide a flat outer surface 43 for mounting the die steels 45. If the cartridge 40 is mounted directly to the upper die shoe 3 or lower die shoe 4, openings 70 in cartridge 40 are aligned with openings 20 and 25, respectively, and the cartridge 40 will close off the other openings in the die shoes 3 and 4.

Figure 10:
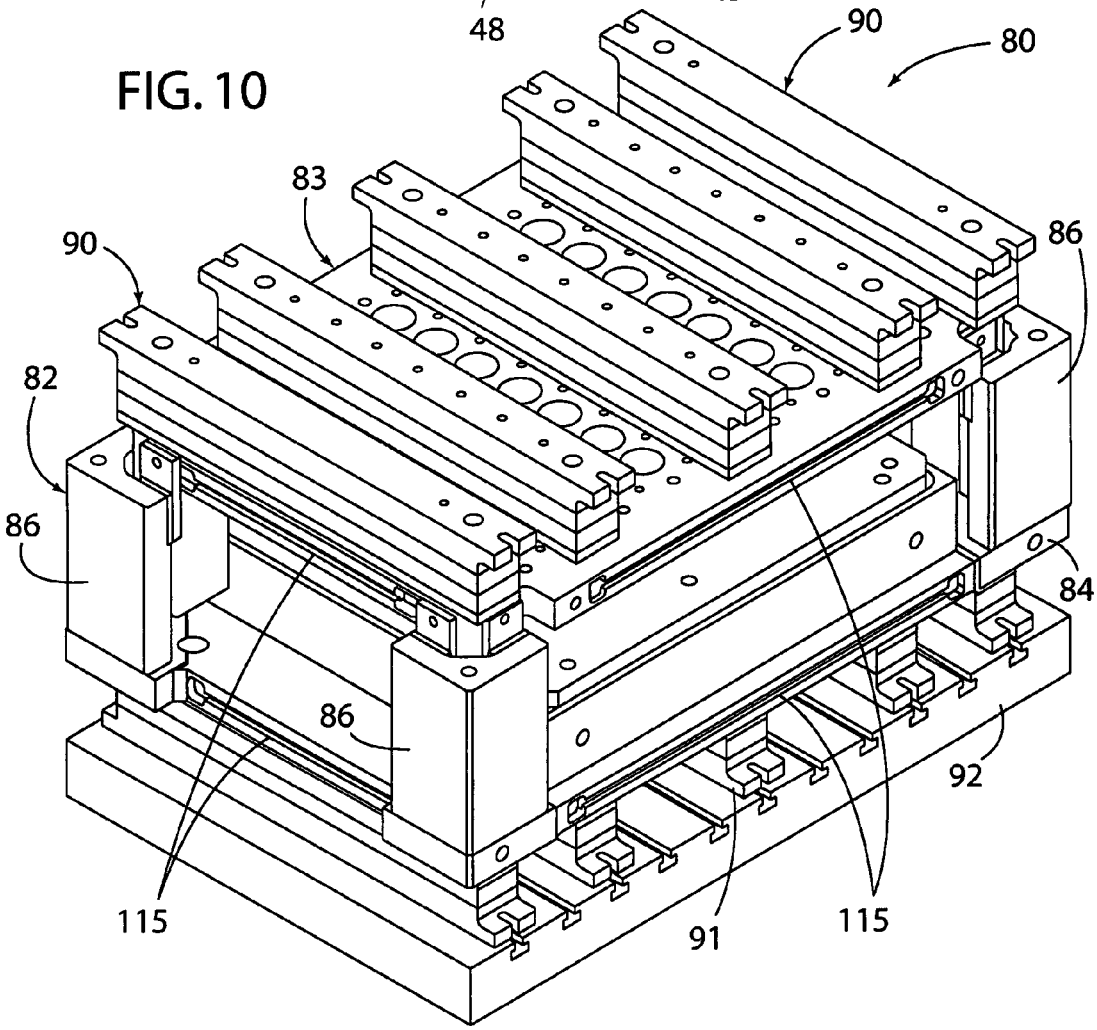
FIG. 10 is an isometric view of a tooling system according to another aspect of the present invention.
Figure 12:
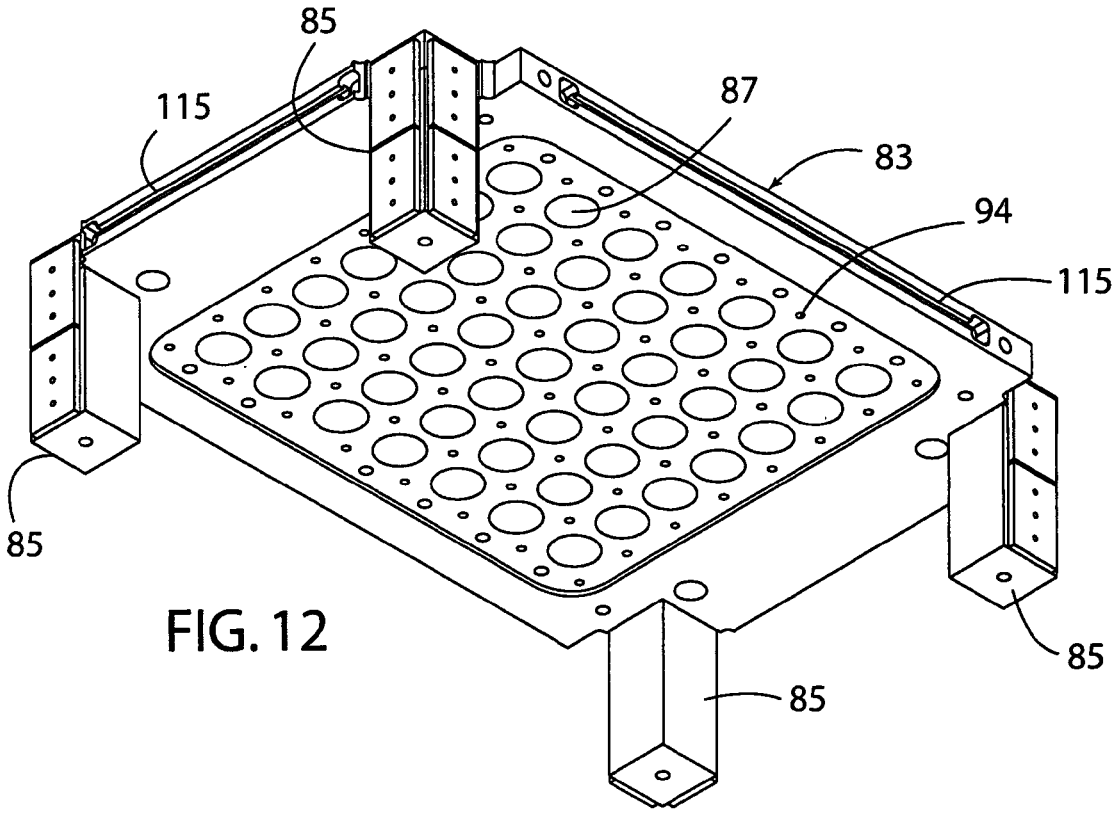
FIG. 12 is an isometric view of an upper die shoe of the tooling system of FIG. 10.
Figure 13:
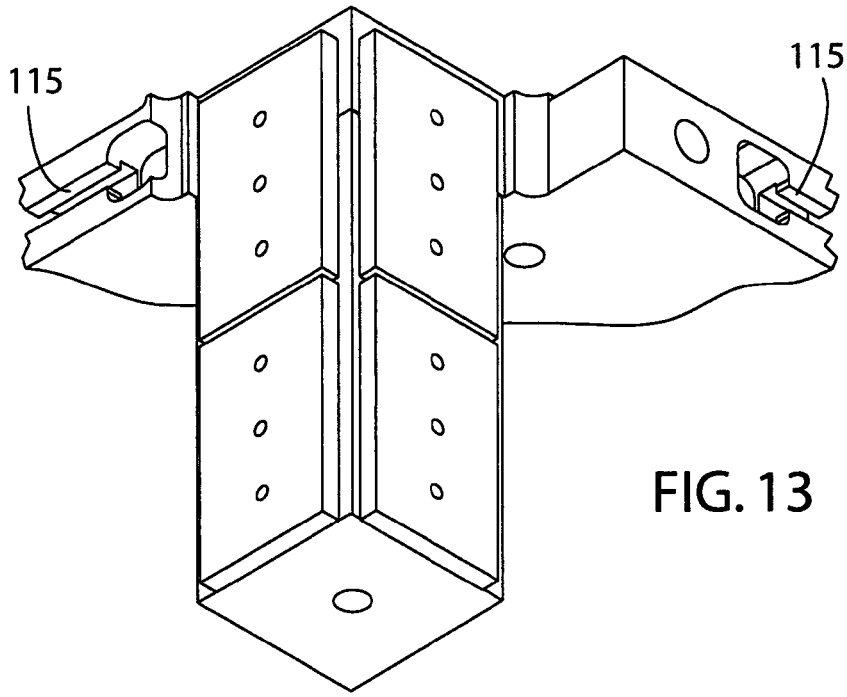
FIG. 13 is a partially fragmentary isometric view of a portion of the upper die shoe of FIG. 12.

With further reference to FIG. 10, a tooling system 80 according to another aspect of the present invention includes a die set 82 having an upper die shoe 83 and a lower die shoe 84 that are slidably interconnected by guide pins 85 and heels 86 in substantially the same as the tooling system 1 described above. A plurality of upper parallels 90 and lower parallels 91 are multi-piece assemblies that are substantially similar to parallels 10 and 11 described in more detail above. The parallels 90 and 91 secure the tooling system 80 to a lower bolster 92 and upper bolster (not shown) of a press machine. A plurality of openings 87 in upper die shoe 83 and openings 91 in lower die shoe 84 provide for mounting nitrogen springs in the tooling system 80 in substantially the same manner as described above in connection with tooling system 1. A shallow pocket 93 is formed in lower die shoe 84, and shallow pocket 94 is formed in upper die shoe 83. The pockets 93 and 94 provide for mounting of cartridges 40 in substantially the same manner as described in detail above. If required for a particular application, risers 35 may be mounted to the upper die shoe 3 and/or lower die shoe 4 in substantially the same manner as described in detail above in connection with the tooling system 1. It will be readily apparent that the tooling system 80 is one-half the size of the tooling system 1. The tooling system 80 is therefore suitable for smaller parts.

Figure 14:
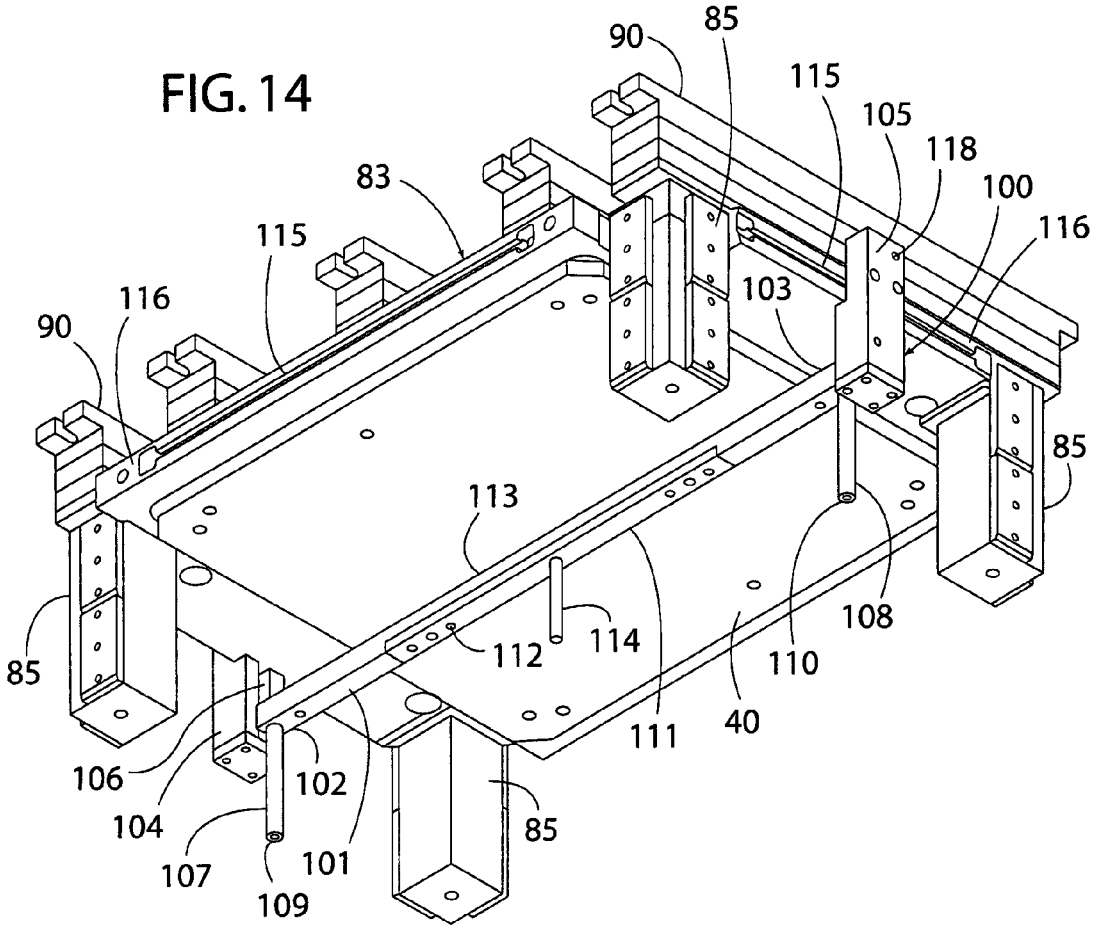
FIG. 14 is an isometric view of an upper half of the tooling system of FIG. 10.

However, tooling system 80 also differs from tooling system 1 in that tooling system 80 includes a lifter bar assembly 100. With further reference to FIG. 14, the lifter bar assembly 100 includes an elongated bar member 101 having opposite ends 102 and 103 that are slidably connected to linear guides 104 and 105. Linear guides 104 and 105 include a groove or guide surface 106, and a spring (not shown) or the like. The spring biases the elongated bar member 101 away from the die shoe 83. It will be understood that a lifter bar assembly 100 may also be mounted to the lower die shoe 84. A pair of stand-offs 107 and 108 are mounted to the bar member 101 adjacent the opposite ends 102 and 103. In use, the ends 109 and 110 of stand-offs 107 and 108 contact the upper surface 95 (see also FIG. 11) of lower die shoe 84 as the die shoes 83 and 84 are being brought together, and the stand-offs 107 and 108 thereby compress the springs of linear guides 104 and 105 and push the bar member 101 towards the upper die shoe 83.

An insert 111 is secured to a central portion 113 of bar member 101 by conventional threaded fasteners 112 or the like. A pilot or pin 114 is mounted to the insert 111.

In use, a piece of sheet metal or blank to be formed in die 80 is provided a hole having a size and shape closely corresponding to the pilot 114. The pilot 114 inserts the hole in the blank and thereby retains the blank in position during the forming process. In general, the blank may be positioned in engagement with pilot 114 prior to bringing the die shoes 83 and 84 together, or the blank may be positioned by hand or utilizing other known guide/positioning devices (not shown), and the pilot 114 then enters the hole through the blank as the die shoes 3 and 4 are brought together to thereby ensure that that blank does not move due to the forming of the sheet metal. Because the insert 111 is mounted to the bar 101 by conventional threaded fasteners 112, the insert 111 can be readily removed and replaced. A new insert 111 having a different pilot 114 mounted thereto can be quickly and easily mounted to the bar 101. If required, more than one pilot 114 can be mounted to the insert 111 if required for a particular application.

Figure 11:
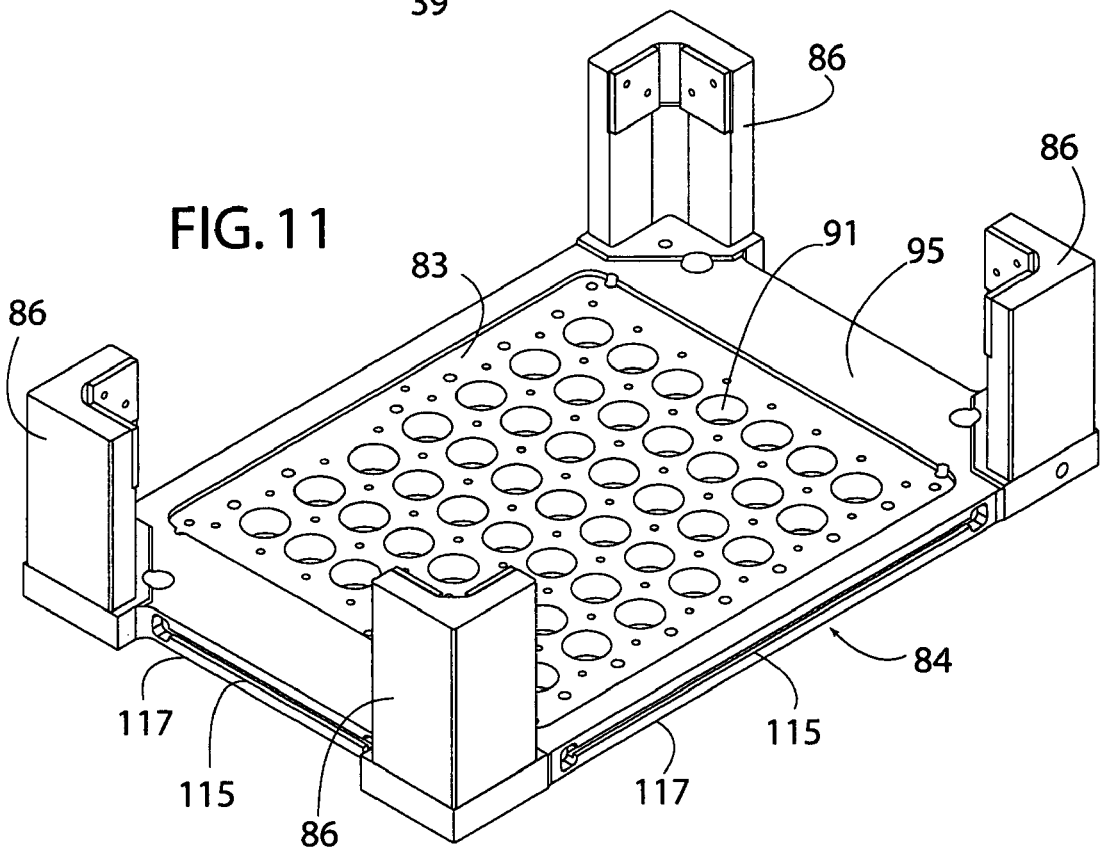
FIG. 11 is an isometric view of a lower die shoe of the tooling system of FIG. 10.

The upper and lower die shoes 83 and 84 include outwardly-facing T-slots 115 extending along the peripheral side surfaces 116 of the upper die shoe 83 (FIG. 14), and the lower die shoe 84 (FIG. 11). When assembled, threaded fasteners extend through openings 118 (FIG. 14) in linear guides 104 and 105, and conventional T-nuts (not shown) are received in the T-slots 115. The T-slots 115 thereby permit the location of the lifter bar assembly 100 to be changed relative to the die shoe 3 and die shoes 83 and 84. In this way, tooling system 80 can be readily reconfigured to provide a pilot 114 in a specific location as required for different parts to be made in tooling system 80. It will be understood that the lifter bar assembly 100 may be provided in the tooling system 1 by forming T-slots 115 in the die shoes 3 and 4.

The tooling systems 1 and 80 of the present invention can be utilized in a variety of different scenarios. For example, the tooling systems 1 and 80 may be utilized to fabricate a relatively small number of prototype parts from sheet metal or the like. In this situation, the die steels and other components may be made from cast metal or the like having limited durability such that the die steels and components are not suitable for larger production runs of parts. In the prototyping environment/situation, the cartridges 40 and die steels 45 can be quickly and easily removed from the die shoes 3 and 4, and different die steels 45 and cartridges 40 can be installed. As discussed above, risers 35 can be utilized as required to accommodate the tooling system for different types of prototype parts.

In another application, the tooling systems 1 and 80 may be utilized to develop the production die steels for a production die. For example, the die steels 45 may be made from conventional hardened tool steel as required for a production die. The components 45 are mounted to a cartridge 40 and mounted in the die shoes. A small number of parts can be formed in the die to determine if the die steels 45 are deforming the steel in the desired manner. To the extent required, the die steels can be machined, moved, and otherwise modified as required. The tooling system 1 (or 80) can be utilized to fabricate a production die by providing a way to test the die steels before they are installed in the production die. It will be understood that a production progressive die or the like may include a very large number of stations, such that utilizing the production die shoes to run small number of parts for development of the die steels may be difficult because the entire die set needs to be moved and loaded into the press each time a station is to be tested. This normally requires use a very large press designed to accommodate a large die, and this process also makes it impossible to do any other work on the die shoes while they are loaded in the press. By utilizing a tooling system 1 according to the present invention, a die maker can load the tooling system 1 into a press, and mount the die steels 45 to the shoes 3 and 4 to test and develop the die steels 45, and the production die set (upper and lower die shoes) is left in the work area. Typically, a second person can continue to work on the various components being mounted to the production die shoes while the die steels 45 are loaded in a press in tooling system 1. In this way, the length of time required to fabricate a die can be substantially reduced.

In yet another application or environment, a tooling system 1 (or 80) according to the present invention can be utilized to fabricate production parts having a relatively low volume. The production shop can have a number of die steels 45 and cartridges 40 pre-made so the tooling system 1 (or 80) can be readily adapted to fabricate different types of parts. The die shoes of the tool may be left in the press after a run of production parts, and the cartridges 40 and tool steels 45 can be removed and replaced with other cartridges 40 and tool steels 45 designed to fabricate an entirely different part. In this way, the production facility does not need to have a completely different die for each part that is produced at the facility. Rather, only the cartridges and die steels themselves are different for each part being produced. In this way, the cost associated with the tooling for the various different parts is greater reduced. Also, the cartridges 40 and tool steels 45 can be readily removed from the die shoes 2 and 3, and replaced. It will be understood that switching to different cartridges and die steels in this way is substantially faster and easier than removal of an entire die from the press, followed by setting up an entirely new and different die set in the press.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A re-usable tooling system adapted to be reconfigured to fabricate parts from sheet metal, wherein the parts having different sizes and shapes, the tooling system comprising:

first and second die shoes operably interconnected by linear guides, the shoes having inner sides facing one another, at least the first die shoe having a plurality of spring-receiving pockets in the inner side arranged to define an array of spring-receiving pockets;

a plurality of resilient members disposed in selected ones of the spring-receiving pockets, wherein the number of resilient members is substantially less than the number of spring-receiving pockets;

a plate member secured to the first die shoe having a plurality of spring-receiving pockets, the plate member closing off a plurality of the pockets that do not have resilient members disposed in them, the plate member simultaneously providing clearance at the pockets having resilient members disposed in them;

a plurality of die steels mounted to the plate member, including at least one metal-forming component operably connected to a selected one of the resilient members such that the metal-forming component shifts as the first and second die shoes move relative to one another.

2. The tooling system of claim 1, wherein:

the plate member comprises a first plate member, and including:

a second plate member secured to the second die shoe.

3. The tooling system of claim 1, wherein:

the spring-receiving pockets form rows.

4. The tooling system of claim 1, including:

a plurality of parallels secured to an outer side of the first die shoe, and wherein:

at least one of the spring-receiving pockets comprises a blind hole having a cylindrical sidewall and a base surface transverse to the cylindrical sidewall formed in a selected one of the parallels.

5. The tooling system of claim 1, wherein:

the one of the first and second die shoes to which the plate member is secured has an enlarged shallow pocket, and the plate member is at least partially received in the enlarged shallow pocket.

6. The tooling system of claim 5, wherein:

the enlarged shallow pocket defines a recessed base surface, and wherein at least some of the spring-receiving pockets are formed in the recessed base surface.

7. The tooling system of claim 1, wherein:

at least one of the resilient members comprises a nitrogen spring.

8. The tooling system of claim 1, wherein:

the selected one of the first and second die shoes includes a plurality of connector-engaging features;

the plate member comprises a first plate member; and including:

a second plate member positioned beside the first plate member; and a plurality of fasteners engaging the connector-engaging features to and securing the first and second plate members to the selected ones of the first and second die shoes.

9. The tooling system of claim 8, wherein:

the connector-engaging features are arranged in a repeating pattern; and the first and second plate members define corresponding connecting features that align with the connector-engaging features when the first and second plate members are installed.

10. The tooling system of claim 1, including:

a lifter bar assembly having an elongated cross member extending across a central portion of a selected one of the first and second die shoes, the lifter bar including a pair of slides movably supporting the cross member at opposite ends of the cross member, resilient members biasing the cross member away from the die shoe to which it is mounted, wherein the lifter bar assembly is adjustably mounted to the selected one of the first and second die shoes.

11. The tooling system of claim 1, wherein:

the first and second die shoes define outer sides opposite the inner sides; and including:

a plurality of parallels connected to the outer side of the first die shoe, each parallel comprising at least two elongated members having parallel opposite side faces.

12. The tooling system of claim 11, wherein:

at least one of the spring-receiving pockets is defined in part by an opening through the first die shoe;

a first one of the elongated parallel members includes at least one opening aligned with the opening through the first die shoe, and at least a portion of a first resilient member is disposed in the opening in the first elongated parallel member.

13. The tooling system of claim 12, wherein:

the opening in the first elongated parallel member comprises a through-hole, and the first resilient member has an end portion engaging a support surface of a second elongated member, the support surface defining a transverse base surface of a spring-receiving pocket defined, in part, by the opening through the first die shoe.

14. A reconfigurable die system, comprising:

a die including first and second die shoes that are operably interconnected by linear guides, wherein the first die shoe defines generally parallel opposite edge portions that are spaced-apart from one another and include elongated connecting features adjacent the opposite edge portions, providing a plurality of positions along said connecting features to which die lifter guides can be releasably secured;

metal-forming components secured to the first and second die shoes for forming a piece of metal in the die when the first and second die shoes are brought together in use;

lifter bar assembly including a pair of linear die lifter guides releasably securable to said connecting features at any of said plurality of positions along said connecting features, and an elongated bar having opposite ends movably supported by the linear guides, the linear guides biasing the elongated bar away from the first die shoe, the lifter bar assembly further including a locating pin mounted to a central portion of the elongated bar and extending transversely from the elongated bar; and wherein:

the locating pin is removably connected to the elongated bar so it can be removed and replaced when the die is reconfigured, and the linear guides can be connected to any of said plurality of positions along said connecting features such that the lifter bar assembly can be secured along said opposite edge portions of said first die at different locations.

15. The reconfigurable die system of claim 14, wherein:

at least one of the first and second die shoes includes a plurality of spring-receiving pockets; and including:

resilient members received in selected ones of the spring-receiving pockets;

a plate member removably secured to the one die shoe and closing off at least one of the spring-receiving pockets.

16. The reconfigurable die system of claim 14, including:

a plurality of parallels secured to outer faces of the first and second die shoes, each parallel comprising a plurality of elongated members having parallel opposite side surfaces whereby the thickness of the parallels can be adjusted by adding or removing elongated members.

17. A method of providing tooling for production of metal parts, the method comprising the steps of:

providing a die set having first and second die shoes, the first die shoe having a plurality of spring-receiving pockets on an inner side of the first die shoe;

positioning one or more resilient members in a corresponding number of, but less than all of, said pockets;

securing a first plate member to the first die shoe such that the first plate member closes off at least some of the spring-receiving pockets that do not have resilient members in them, and wherein the first plate member is secured to the first die in a manner that does not substantially interfere with said one or more resilient members; and securing a first metal-forming die steel to the first plate member;

fabricating a plurality of first metal parts having a first size and shape by deforming sheet metal in the die utilizing a press machine;

removing the first metal-forming die steel and the first plate member from the die set;

if necessary, repositioning, removing or adding one or more resilient members, but leaving some of said spring receiving pockets open;

replacing the first metal-forming die steel and the first plate member with a second metal-forming die steel and a second plate member which have configurations different from said first metal-forming die and said first plate member;

said second plate member covering at least some of said spring-receiving pockets which do not have resilient members in them;

fabricating a plurality of second parts having a second size and shape that is distinctly different than the first size and shape by deforming sheet metal in the die utilizing a press machine.

18. The method of claim 17, including:

forming a plurality of rows of spring-receiving pockets in the first die shoe.

19. The method of claim 18, including:

forming clearance openings in the plate members in first areas, and leaving second areas of the plate members without clearance openings;

aligning the clearance openings with first ones of the spring-receiving pockets;

positioning the second areas of the plate over second ones of the spring-receiving pockets to thereby close off the second pockets;

positioning the resilient members in the selected pockets with a portion of the resilient members extending through the clearance openings.

20. The method of claim 17, including:

providing mounting features on opposite side edges of a selected one of the first and second die shoes, the mounting features providing for mounting of an article to the one of the die shoes at a plurality of distinctly different locations;

mounting a lifter bar assembly to the mounting features at a first selected location prior to the step of fabricating a plurality first metal parts, the lifter bar assembly including an elongated bar spanning the one die shoe with opposite ends of the bar being movably mounted to linear guides that bias the bar away from the one die shoe;

mounting the lifter bar to the second selected location on said mounting features after the step of fabricating a plurality of first metal parts, but prior to the step of fabricating a plurality of second metal parts.

21. The method of claim 20, wherein:

the elongated bar includes a main bar member defining opposite ends adjacent the linear guides, and a removable insert mounted to a central portion of the elongated bar, wherein the insert is substantially shorter in overall length than the elongated bar; the method including:

mounting a first insert to the elongated bar prior to the step of fabricating a plurality of first parts;

mounting a first locating pin to the first insert at a first location on the first insert, prior to the step of fabricating a plurality of first parts;

removing the first insert and the first locating pin after the step of fabricating a plurality of first parts, followed by:

mounting a second insert to the elongated bar prior to the step of fabricating a plurality of second parts;

mounting a second locating pin to the second insert at a second location that is distinctly different than the first location relative to the one die shoe.

22. The method of claim 21, wherein:

the step of mounting a first locating pin to a first insert includes selecting a first size and shape of the first locating pin;

the step of mounting a second locating pin includes selecting a second size and shape of the second locating pin, wherein at least one of the second size and shape are distinctly different than the first size and shape.

* * * * *